US010271639B2

(12) United States Patent
Carter et al.

(10) Patent No.: US 10,271,639 B2
(45) Date of Patent: Apr. 30, 2019

(54) APPARATUS FOR PROVIDING AN ASSISTIVE WORK SURFACE LIFTING FORCE FOR A HEIGHT-ADJUSTABLE WORK SURFACE

(71) Applicant: GLOBE STAMPING COMPANY LIMITED, Kitchener (CA)

(72) Inventors: Gregory George Carter, Waterloo (CA); Gary Paprocki, Kitchener (CA)

(73) Assignee: Globe Stamping Company Limited, Kitchener, Ontario (CA)

( * ) Notice: Subject to any disclaimer, the term of this patent is extended or adjusted under 35 U.S.C. 154(b) by 41 days.

(21) Appl. No.: 15/348,045

(22) Filed: Nov. 10, 2016

(65) Prior Publication Data

US 2017/0127821 A1 May 11, 2017

Related U.S. Application Data

(60) Provisional application No. 62/253,860, filed on Nov. 11, 2015.

(51) Int. Cl.

| | |
|---|---|
| ***A47B 9/00*** | (2006.01) |
| ***A47B 9/10*** | (2006.01) |
| ***A47B 5/00*** | (2006.01) |
| ***A47B 9/02*** | (2006.01) |
| ***A47B 21/02*** | (2006.01) |

(52) U.S. Cl.

CPC ..... *A47B 9/10* (2013.01); *A47B 5/00* (2013.01); *A47B 9/02* (2013.01); *A47B 21/02* (2013.01)

(58) Field of Classification Search

CPC .... A47B 9/00; A47B 9/02; A47B 9/10; A47B 9/14; A47B 5/00; A47B 21/02

See application file for complete search history.

(56) References Cited

U.S. PATENT DOCUMENTS

| | | | | |
|---|---|---|---|---|
| 3,685,779 | A * | 8/1972 | Papritz | A47B 9/02 108/146 |
| 5,107,775 | A * | 4/1992 | Langlais | A47B 9/14 108/147.21 |
| 5,978,988 | A * | 11/1999 | Burchett | A47C 17/40 5/133 |
| 6,038,986 | A * | 3/2000 | Ransil | A47B 9/02 108/145 |
| 6,283,047 | B1 * | 9/2001 | Haller(-Hess) | A47B 9/02 108/145 |
| 8,898,831 | B1 * | 12/2014 | Burchett | A47C 17/52 5/136 |
| 2011/0247532 | A1 * | 10/2011 | Jones | A47B 9/02 108/147 |
| 2015/0250303 | A1 * | 9/2015 | Flaherty | A47B 9/18 108/50.02 |

* cited by examiner

*Primary Examiner* — Matthew W Ing

(74) *Attorney, Agent, or Firm* — Gowling WLG (Canada) LLP; Jeffrey W. Wong

(57) ABSTRACT

An apparatus for adjusting the assistive lifting force capacity of a height adjustable work surface. The apparatus includes a couple of plates which are mounted to a system for providing a system for adjusting the height of the work surface. The plates include a set of connection points for connecting the apparatus to a gas spring. The geometry of the holes and the positioning of the gas spring provide for a more consistent lifting force throughout a range of motion of the work surface.

17 Claims, 20 Drawing Sheets

APPARATUS FOR PROVIDING AN ASSISTIVE WORK SURFACE LIFTING FORCE FOR A HEIGHT-ADJUSTABLE WORK SURFACE

CORRESPONDING APPLICATIONS

This application claims the benefit of U.S. Patent Application No. 62/253,860, filed Nov. 11, 2015, the contents of which are incorporated herein by reference.

FIELD OF THE DISCLOSURE

The disclosure is generally directed to work surfaces and more specifically to an apparatus for providing an assistive work surface lifting force for a height-adjustable work surface.

BACKGROUND OF THE DISCLOSURE

A worksurface, or work surface, which is height-adjustable has recognized advantages over stationary worksurfaces. Among the methods used to allow a worksurface to be height-adjustable is to have a mechanism which utilizes lockable gas springs to counterbalance a large portion of the weight of the worksurface.

These gas springs typically have a set force level, so that gas springs must be installed which have the correct amount of force to counterbalance the weight of each particular worksurface and the worksurface load (the weight of items intended to rest upon that worksurface). This is a disadvantage to manufacturers, who then must know in advance the weight of the worksurface and its load, and must prepare a mechanism with gas spring forces specific to that total weight. This is also a disadvantage to customers, who may at some future point want to use the worksurface with a different load, and will find that the counterbalancing force provided by the gas springs is either too weak or too strong for the new load weight.

It is also recognized that the force provided from the gas springs is not consistent through the range of compression and extension of the gas springs. This has meant in prior versions of height-adjustable mechanisms that there exists a stronger counterbalancing force when the gas springs were more compressed at the lower positions of the worksurface and a weaker counterbalancing force when the gas springs were more extended at the higher positions of the worksurface providing an inconsistent benefit to customers.

Therefore, there is provided a novel apparatus for providing an assistive work surface lifting force for a height-adjustable work surface.

SUMMARY OF THE DISCLOSURE

The disclosure is directed at an apparatus for providing an assistive lifting force to a height-adjustable work surface. The height of the work surface may be adjusted via a height-adjustment system. The apparatus of the disclosure includes a pair of plates connected, or mounted, to the height-adjustment system, the plates including a set of holes for receiving a fastener to connect the apparatus with the height-adjustment system. The plates are connected to the height-adjustment system via a gas spring. In one embodiment, the geometry of the holes and the angle of attachment of the gas spring are designed to provide a more consistent lifting force to the work surface throughout a range of motion of the work surface.

In one aspect of the disclosure, there is provided a system for providing an adjustable assistive lifting force for a height-adjustable work surface including a height-adjustable work surface apparatus, the height-adjustable work surface apparatus including a set of gas springs; a pair of plates, each of the plates including a set of connection points for receiving a fastening apparatus connecting the plates to one of the set of gas springs; wherein the set of connection points are in an arc with respect to a target pivot point.

In another aspect, the fastening apparatus is a shoulder bolt. In yet a further aspect of the disclosure, the height-adjustable work surface apparatus includes a pair of work surface mechanisms, each work surface mechanism including a work surface mounting apparatus; a parallel arm structure, the parallel arm structure at a first end in pivotable connection with the work surface mounting apparatus; and a stationary mounting bracket for receiving a second end of the parallel arm structure. In yet another aspect, the pair of plates are welded to the parallel arm structure. In yet a further aspect, the pair of plates are connected to the parallel arm structure via an intermediary linkage.

In another aspect of the disclosure, there is provided a system for providing adjustable assistive lifting forces to a height-adjustable work surface including a pair of plates, each of the plates including a set of gas spring connection points; a fastening apparatus for connecting a gas spring to one of the gas spring connection points; wherein the set of gas spring connection points form an arc centred about a target pivot point.

In another aspect, the target pivot point is a gas spring pivot point. In yet another aspect, the gas spring connection points are designed to provide a more constant assistive lifting force to a work surface over a range of motion of the work surface. In yet a further aspect, the pair of plates are mounted to an apparatus for adjusting a height of the height-adjustable work surface. The pair of plates may be welded to the apparatus for adjusting the height or may be connected to the apparatus via an intermediary linkage.

BRIEF DESCRIPTION OF THE DRAWINGS

Embodiments of the disclosure will now be described, by way of example only, with reference to the attached drawings, in which.

DETAILED DESCRIPTION OF THE DISCLOSURE

The disclosure is directed at an apparatus for providing an adjustable assistive work surface lifting force for a height-adjustable work surface. In one embodiment, the apparatus includes a pair of plates having a set of connection points to which a gas spring is connected. In a preferred embodiment, the gas spring is connected to one of the set of connection points via a removable bolt. By connecting the gas spring to different points within the set of connection points, the resulting work surface lifting force may be adjusted. An advantage of the current apparatus is that the counterbalancing of the weight of the work surface is more consistent through the full range of motion as the work surface is raised or lowered by the apparatus. Another advantage of the current disclosure is that a single gas spring may be used for each height-adjusting mechanism to provide different lifting forces.

Furthermore, another advantage is that the lifting force of the work surface may be adjusted after manufacturing is complete whereby adjustment of the lifting force may be performed by a user of the apparatus (when necessary). Also, the current apparatus provides a more consistent lifting forces through a range of motion of the work surface as it is raised or lowered. The apparatus of the disclosure also provides improved control of the downward movement of the work surface.

Figure 1A:
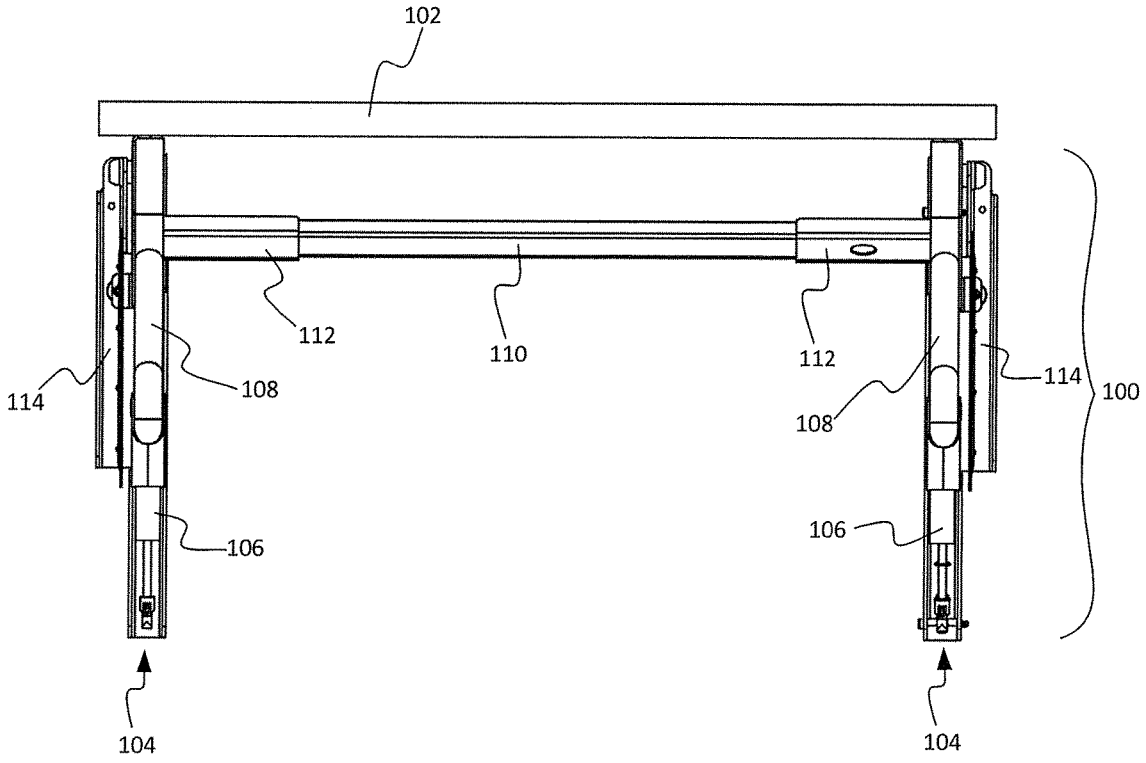
FIG. 1*a* is a front view of an embodiment of apparatus for providing an assistive work surface lifting force for a height-adjustable work surface in a lowered position.
Figure 1B:
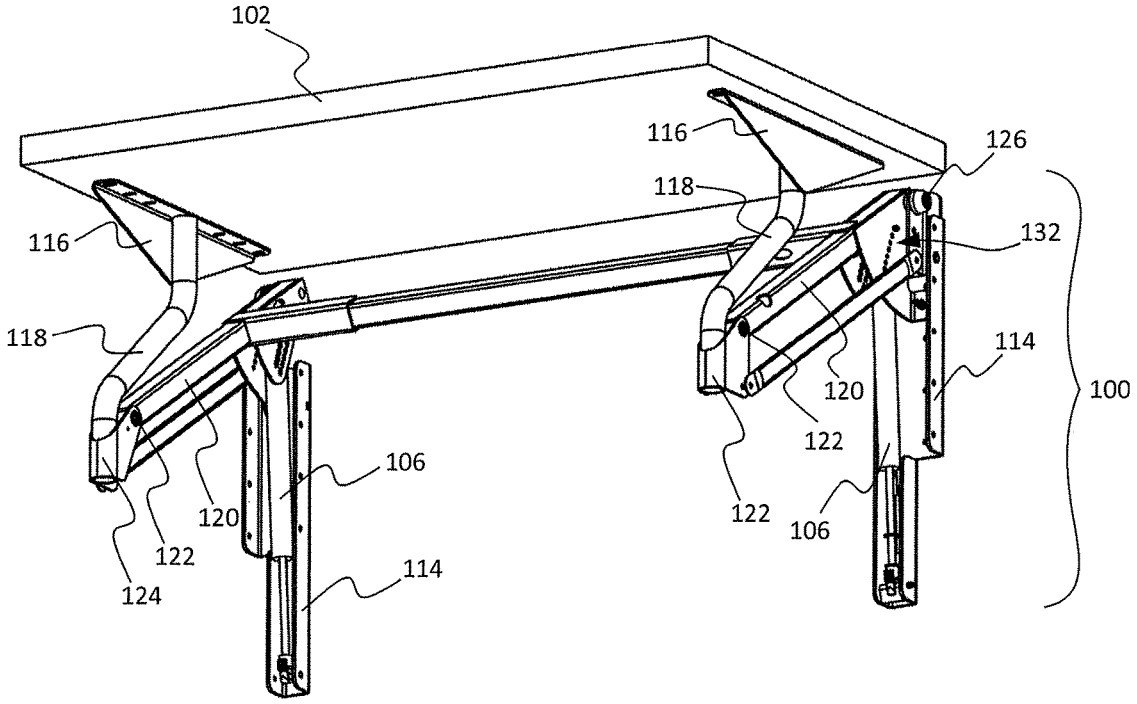
FIG. 1*b* is a bottom perspective view of the apparatus of FIG. 1*a;*
Figure 1C:
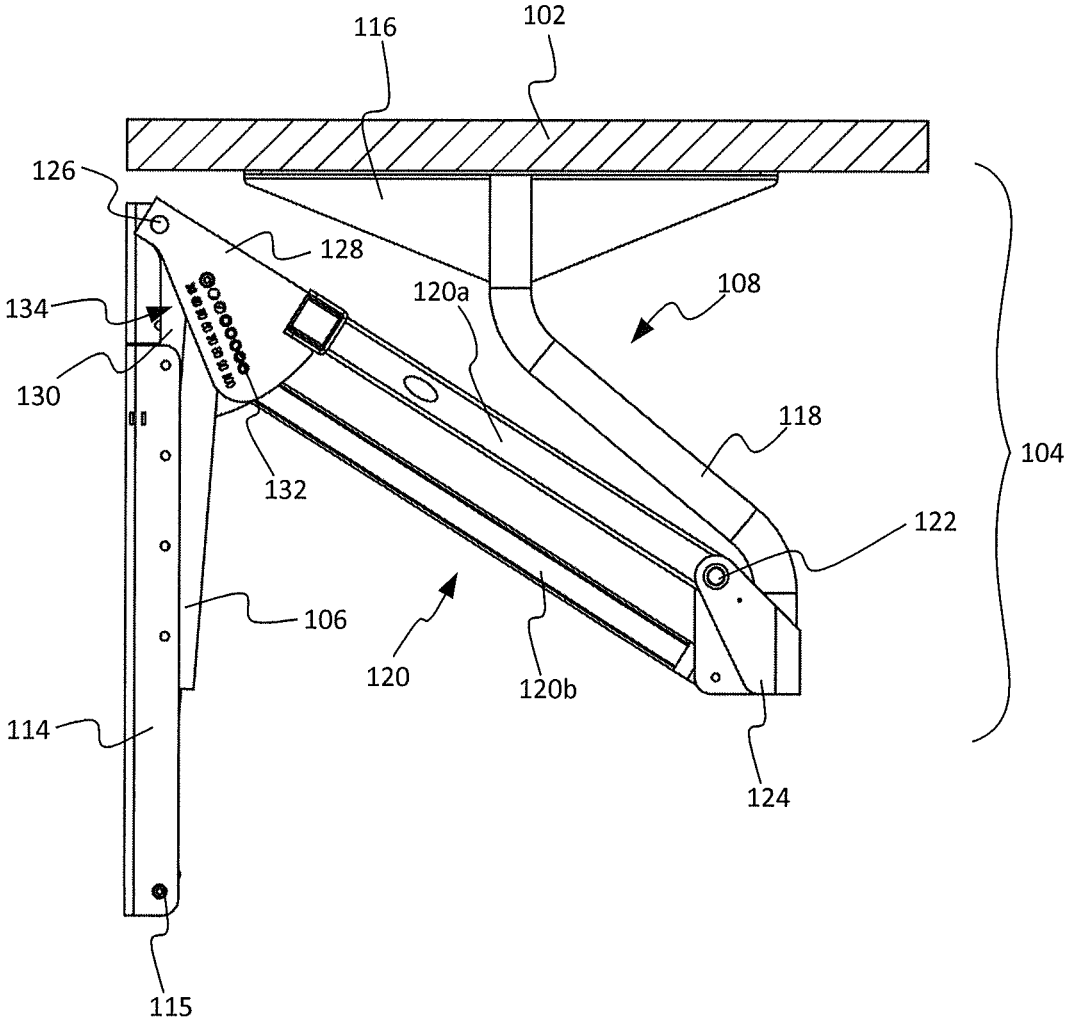
FIG. 1*c* is a side view of the apparatus of FIG. 1*a* from a central position.

Turning to FIGS. 1*a*, 1*b* and 1*c*, front, perspective and side views, respectively, of a system for providing a height-adjustable work surface are shown. FIG. 1*c* is a side view from a central location underneath the work surface. The system also provides an apparatus for providing an assistive work surface lifting force for a height-adjustable work surface. In FIGS. 1*a* to 1*c*, the system 100 is shown supporting a work surface 102 in a lowered, or lowest, position. While it can be seen in the current figures that the apparatus 100 includes a pair of each part, some of the following description is directed at a discussion in the singular for clarity. It will be understood that the description will apply to all similar parts within the apparatus 100.

Turning to FIG. 1*a*, the system 100 includes a set of height-adjusting mechanisms 104 mounted to an underside of the work surface 102. In the current embodiment, the system 100 includes two mechanisms 104 located at opposite ends of the work surface 102. Each of the mechanisms includes a gas spring 106 and a work surface mounting apparatus 108. The mechanisms 104 are connected via a central bar, or cross-tube 110 which assists to co-ordinate the movement of the set of mechanisms 104 when adjusting the height of the work surface 102. Each of the mechanisms 104 includes a cross-tube bracket 112 for receiving an end of the cross-tube 110. As will be disclosed in more detail below, each mechanism 104 is connected to a stationary mounting bracket 114. The stationary mounting bracket 114 may be used to mount the work surface 102 and the system 100 to a wall and the like. Alternatively, the stationary mounting bracket 114 may be connected to a modesty panel and two end gables. Also, the stationary mounting bracket 114 may be connected through adapters into an office panel system.

As shown in FIG. 1*c*, which is a side view of the system, one of the mechanisms is more clearly depicted. The mechanism 104 includes a work surface bracket 116 which is attached to one end of an arm 118 which extends from the work surface bracket 116 to a second bracket 124. The arm 118, the work surface bracket 116 and the second bracket 124 may be seen as the work surface mounting apparatus 108. The work surface mounting apparatus 108 provides support to the work surface 102.

The work surface mounting apparatus 108 is pivotally connected to a parallel arm structure 120 via a pivoting connection 122 within the bracket 124. The parallel arm structure 120 includes a primary arm 120*a* and a secondary arm 120*b* which move in parallel with respect to each other.

In the current embodiment, the primary arm 120*a* is connected to the pivoting connection 122 while the secondary arm 120*b* is also in pivotable connection with the bracket 124. The other end of the primary parallel arm structure 120*a* is pivotally connected to the stationary mounting bracket 114 at a parallel arm fulcrum point 126 defined within a first plate 128 and a second plate 130. Further details are provided below with respect to FIG. 3. The other end of the secondary arm 120*b* is also pivotally connected to the stationary mounting bracket 114 (FIG. 1*b*).

The mechanism 104 further includes an apparatus 134 for providing an assistive work surface lifting force for the work surface 102. In one embodiment, the assistive work surface lifting force may be controlled or adjusted by the user. The apparatus 134 includes the gas spring 106 which is connected at its top end to the plates 128 and 130 via one of the set of connection points 132. As will be understood, the gas spring is also used to assist in adjusting the height of the work surface.

Each of the plates 128 and 130 includes the set of gas spring connection points 132 whereby, depending on the desired assistive lifting force, the gas spring 106 can be connected accordingly. The force provided by the gas spring 106 also rotates the parallel arm structure 120 of each mechanism 104 to raise and lower the work surface 102 as needed.

In the current embodiment, the provision of the multiple connection points 132 rather than a single connection point, provides different options for the connection between the gas spring 106 and the plates 128 and 130. The multiple connection points 132 are associated with specific assistive lifting force capacities for the work surface 102. In FIGS. 1*a* to 1*c*, the gas spring 106 is connected to the connection point 132 representing a highest assistive lifting force capacity. It should be noted that the height of the work surface is not related to the assistive lifting force capacity of the work surface and that these two characteristics are distinct from each other. The other end of the gas spring 106 is preferably connected to the stationary bracket 114 at a gas spring fulcrum or pivot point 115.

Figure 2A:
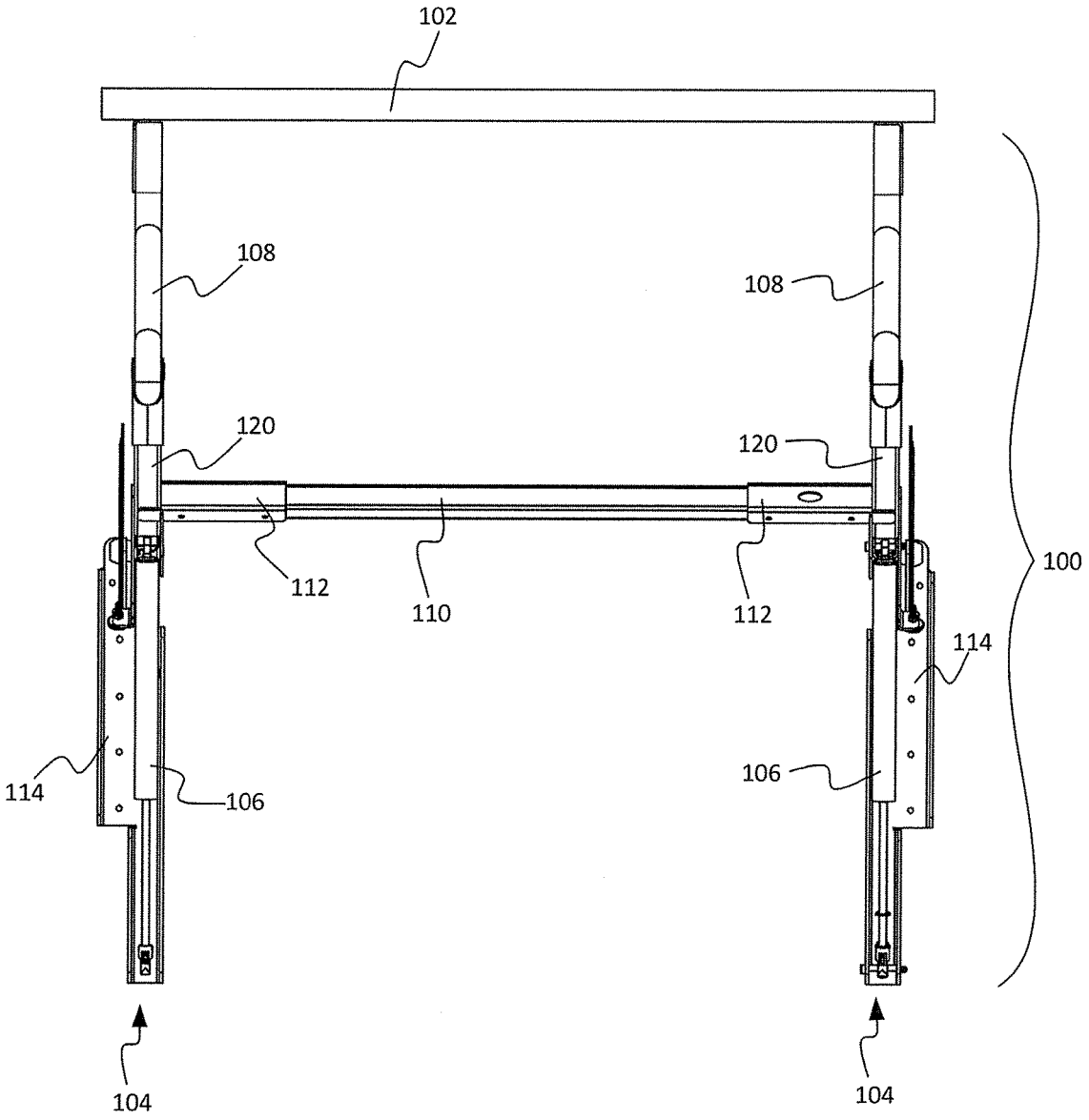
FIG. 2*a* is a front view of the apparatus of FIG. 1*a* in a raised position.
Figure 2B:
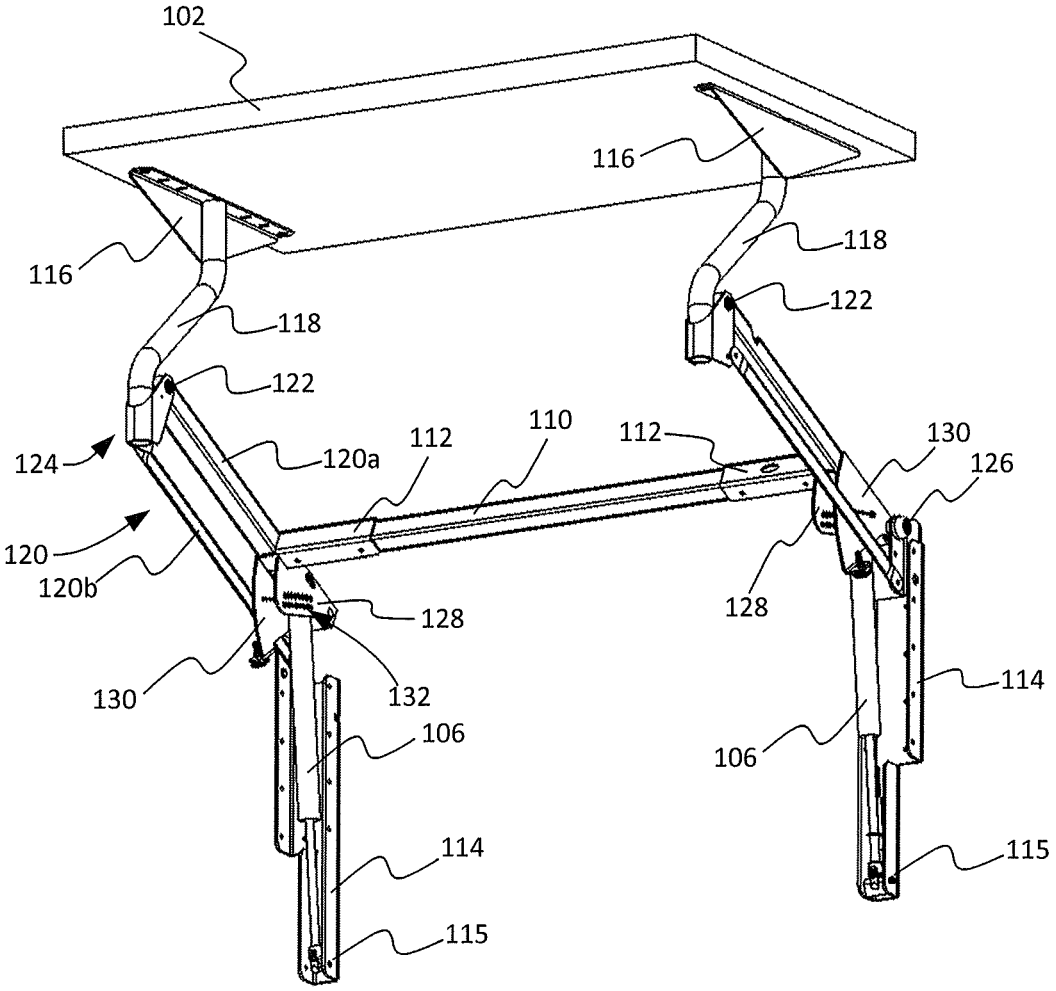
FIG. 2*b* is a bottom perspective view of the apparatus of FIG. 2*a;*
Figure 2C:
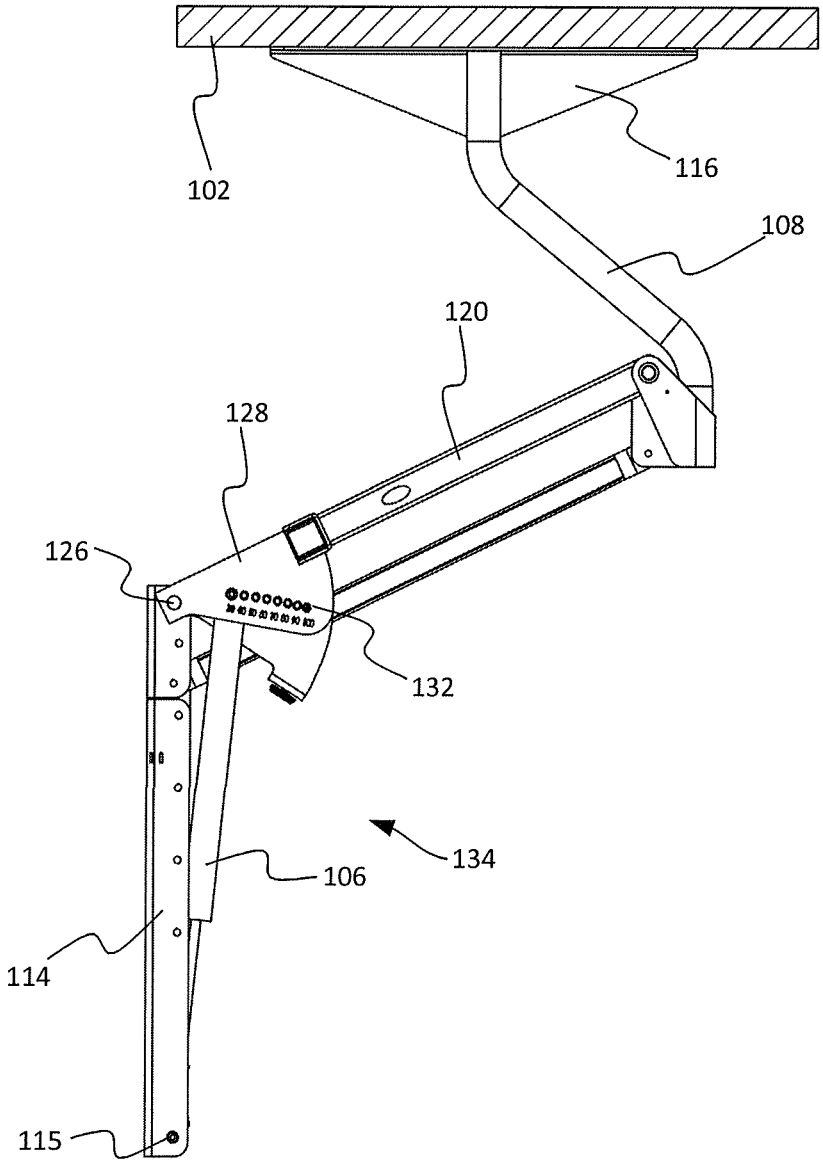
FIG. 2*c* is a side view of the apparatus of FIG. 2*a* from a central position.

Turning to FIGS. 2*a*, 2*b* and 2*c*, front, perspective and side views, respectively, of the apparatus for providing a height-adjustable work surface is shown. As with above, FIG. 2*c* is a side view from a central position. In these Figures, the work surface is seen as being in a raised, or highest, position.

As can be seen in FIGS. 2*a* to 2*c*, while the work surface 102 is in the raised position, in the current embodiment, the assistive lifting force capacity of the work surface is maintained at approximately the same level as shown in FIGS. 1*a* to 1*c* i.e. the connection point between the gas spring and the plates is not changed. In a preferred embodiment, the system provides a lifting force that is as close to constant as possible during the range of motion of the work surface between the lower position for FIGS. 1*a* to 1*c* to the raised position of FIGS. 2*a* to 2*c*. If a lower weight-bearing, or assistive lifting force capacity is required, the gas spring 106 can be connected to another of the connection points in the set of connection points 132 by removing and then re-inserting the bolt through the gas spring 106 and another of the set of connection points 132.

Figure 3:
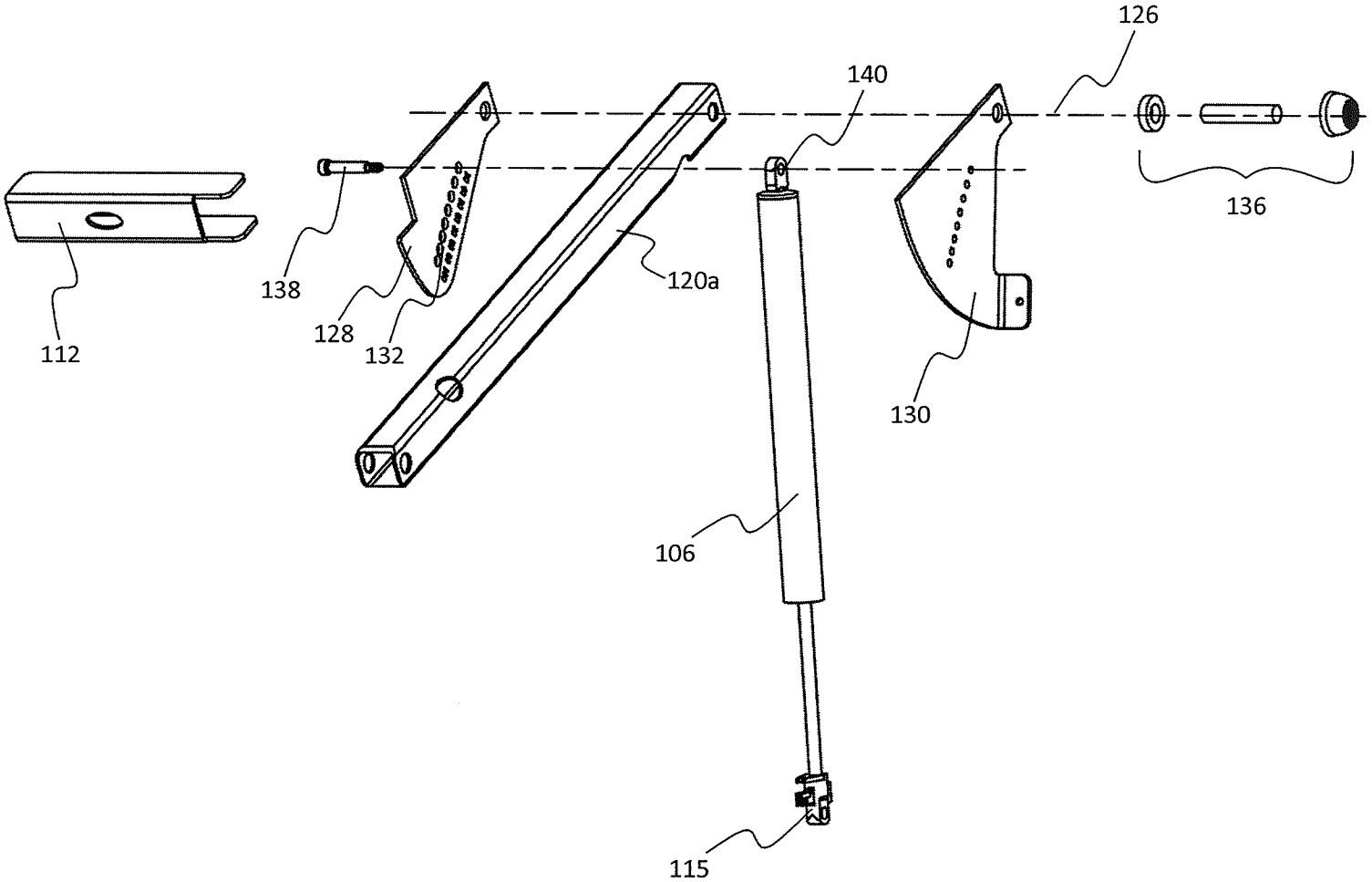
FIG. 3 is an exploded view of a portion of the apparatus of FIG. 1*a;*

Turning to FIG. 3, an exploded view of the apparatus for adjusting an assistive lifting force capacity is shown. FIG. 3 provides a more detailed schematic of the apparatus 134 showing the connection between the primary arm 120*a* of the parallel arm structure 120, the plates 128 and 130 and the gas spring 106.

In this embodiment, the primary arm 120*a*, which may be a steel tube, is connected to the plates 128 and 130 via a fastening mechanism 136 at, or along, the parallel arm fulcrum point 126. The primary arm 120*a*, and the plates, can then pivot about the parallel arm fulcrum point 126, when necessary, to adjust the height of the work surface 102. In one embodiment, the primary arm 120*a* is welded to the plates 128 and 130 in order to strengthen the connection between the arm 120*a* and the plates 128 and 130 and the overall structure. In one embodiment, the tightening of the fastening mechanism 136 also assists to sandwich the primary arm 120*a* between the two plates 138 and 130. The cross-tube bracket 112 may also be welded to the primary arm 120*a*.

The gas spring 106 is connected to the plates 128 and 130 via a fastener, such as, but not limited to, a shoulder bolt 138, to one of the connection points within the set of connection points 132. The gas spring 106 includes a hole 140 at a top of the gas spring 106 to receive the shoulder bolt 138.

These multiple connecting or pivot points 132 are at various distances from the parallel arm fulcrum point 126 on the stationary mounting bracket 114. The further the parallel arm fulcrum point 126 is from a connecting point 132, the greater the leverage or stronger the torque about the parallel arm fulcrum point 126 for the primary arm 120*a*. In other words, when the gas spring 106 is connected to a point closer to the parallel arm fulcrum point 126, the gas spring 106 provides less rotational force to the parallel arm structure 120 than when the gas spring is connected to a point further from the parallel arm fulcrum point 126. In this way, the fixed force of a gas spring can be applied such that the resulting lifting force may be adjusted to be stronger or weaker. In the current embodiment, a desired range of resulting lifting forces of the work surface is between 30 to 100 pounds. The lifting forces may then be controlled or adjusted to control the weight-bearing capacity, or the lifting force of the work surface.

Figure 4:
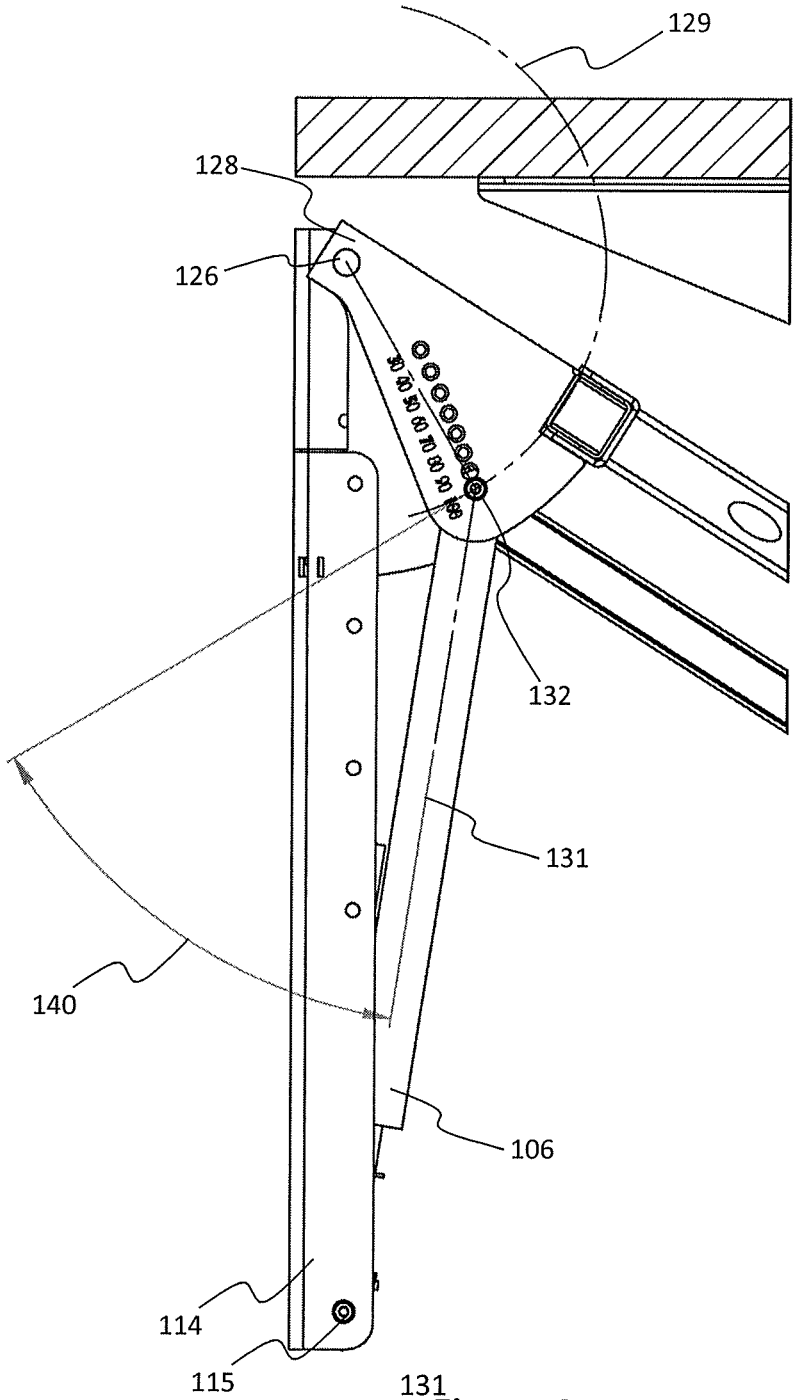
FIG. 4 is a side view of a portion of the apparatus in the lowered position from a central position.
Figure 5:
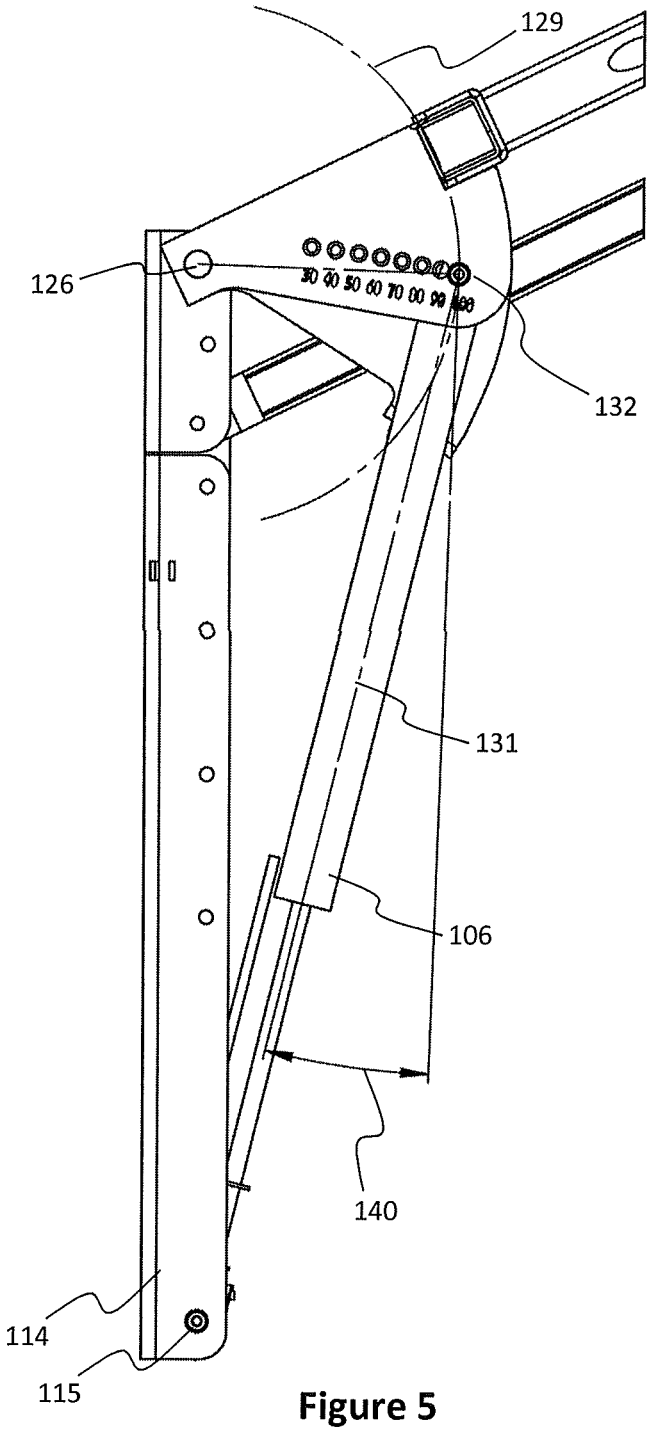
FIG. 5 is a side view of a portion of the apparatus in the raised position from a central position.

Turning to FIGS. 4 and 5, side views (from a central position) of the apparatus for adjusting the assistive lifting force capacity is shown. As can be seen, the set of connecting points 132 follow an arc along the plate 128.

The positioning of the connection points 132 is preferably designed such that the assistive lifting force capacity of the work surface 102 remains approximately constant at the designated lifting force at any position of the work surface between the lowered and raised positions. The designated assistive lifting force is based on the connection point to which the gas spring is connected.

Therefore, the force being exerted by the gas spring 106 at any point may be multiplied by the efficiency of the angle of attachment of the gas spring to provide the approximate expected, or designated, lifting force for the work surface such that the lifting force is more consistent throughout the range of heights of the work surface.

In its completely raised position, all connection points 132 are the same distance from the gas spring fulcrum point 115, so that a gas spring may be moved from one connection point 132 to another without raising or lowering the work surface but rather can be done with the mechanism locked. Therefore it is not necessary to move the gas springs from each mechanism at the same time which facilitates the adjustment between connection points. However, it is understood, that while each mechanism may be set at a different lifting force, it is preferred that both mechanisms be set at the same lifting force.

In operation, when the work surface is in the lowered position, the gas spring 106 may be seen as being in a less efficient position (FIG. 4), however, when the work surface is in the raised position, the gas spring 106 may be seen as being in a more efficient position (FIG. 5). Generally, the gas spring provides a greater linear force when it is compressed (FIG. 4) and less linear force when it is extended (FIG. 5). However, in accordance with the disclosure, the system provides a more constant lifting force over the full range of motion of the work surface such that there is a constant lifting (rotational) force regardless of the amount of compression or extension of the gas spring. In other words, the lifting force of the work surface is the same when the work surface is at its lowest position and at its highest position. The locations of the connection points 132 compensate for the different forces from the gas spring during the range of motion. When a circle 129 is drawn around the parallel arm fulcrum point 126 and passes through the connecting point to which the gas spring 106 is connected and a line 131 drawn from the connecting point to the gas spring fulcrum point 115, if the relationship of the circle 129 and the line 131 are close to being tangential, then the linear force from the gas spring will create a rotational force around the parallel arm fulcrum point 126 more efficiently. If the relationship of the circle 129 and the line 131 are further from being tangential, then the linear force from the gas spring 106 will create rotational force around the parallel arm fulcrum point 126 less efficiently. The geometry of the mechanism is therefore designed so that the angle of attachment of the gas spring 106 is more efficient when the gas spring is extended and has less force and the geometry is less efficient when the gas spring is compressed and has more force. In other words, in one position, the connection point is not close to the tangent (represented by angle 140 in FIG. 4) and may be seen as being geometrically less efficient when the force from the gas spring is stronger and geometrically more efficient and close to tangent represented by angle 140 in FIG. 5) when the force from the gas spring is weaker.

Figure 6:
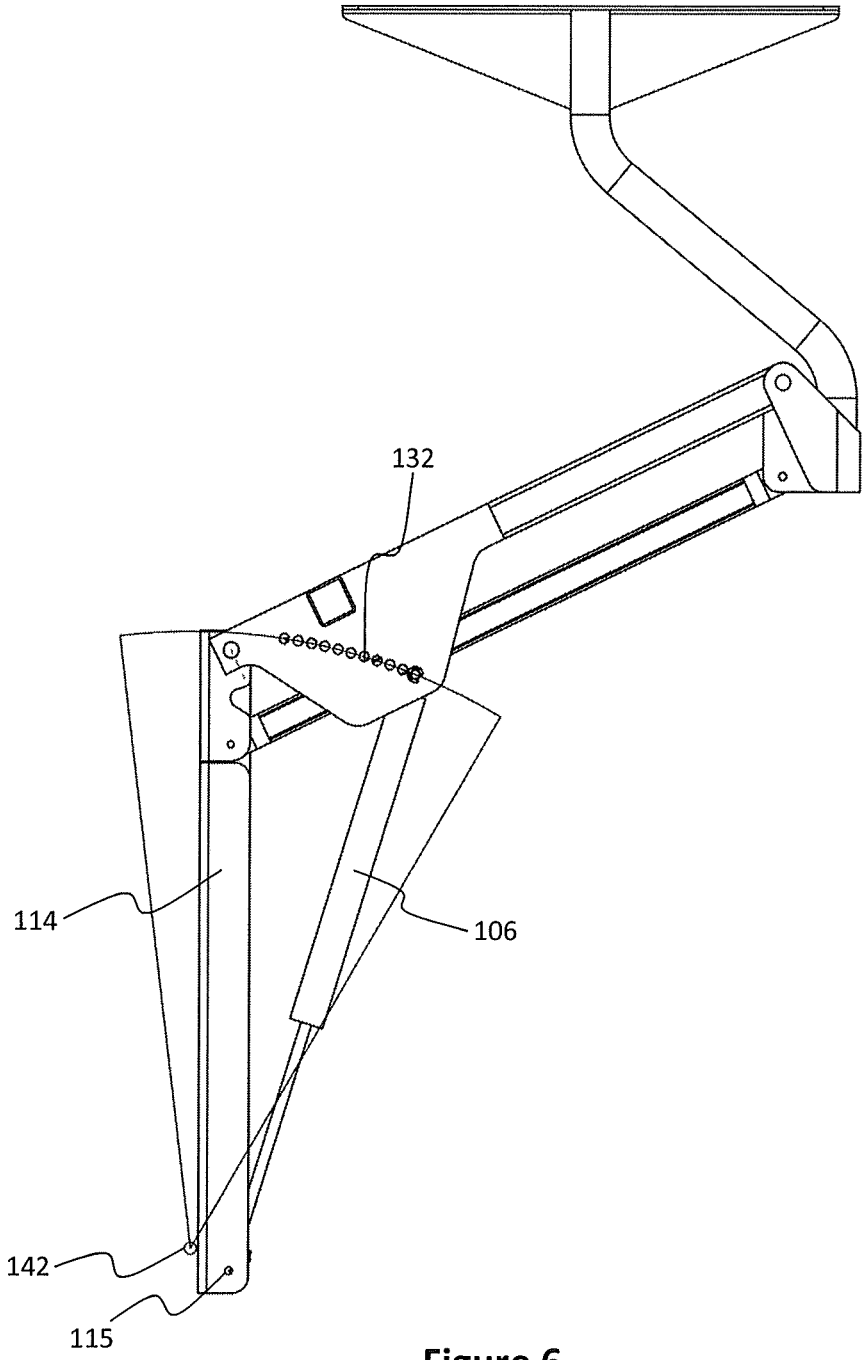
FIG. 6 is a side view of the apparatus in the raised position from a central position.

As shown in FIG. 6, the arc being defined by the set of connecting points 132 follows a circumference of a circle with a target pivot point 142. This target pivot point may be seen as the centre of the arc defined by the connecting points 132. The location of the connection points 132 are preferably located based only on having the geometry compensate for the varying forces from the gas spring, as described above. However, to achieve the advantage of changing the connection of the gas springs 106 between connection points 132 with the mechanism 104, or work surface 102, fixed in one position, in one embodiment of the disclosure, the connection points 132 are adjusted to be centred at pivot point 115. This small adjustment still provides a geometry which partially compensates for the varying force from the gas springs 106 as they extend. All of the connection points 132 are preferably located along the arc centred at the gas spring pivot point 115. As outlined above, the distance of the various connection points 132 to the parallel arm fulcrum point 126 is determined to create a range of resultant lifting forces for the work surface. In one embodiment, the lifting force may be adjusted between approximately 30 to 100 pounds of lift, in 10 pound increments. The lifting force range may also be defined by the characteristics of the gas spring being used.

As outlined above, the positioning of the set of connection points is selected or designed with a consideration to providing a somewhat consistent counterbalancing force for each connection point over the range of motion of the work surface. It was noted that when the work surface is in its uppermost position, the target pivot point 142 of the arc 132 is relatively close to the point where the bottom of the gas spring 106 connects pivotally to the gas spring pivot point 115 at a bottom of the stationary mounting bracket 114. It was recognized that it would be advantageous to shift the arc of connection points 132 slightly so that the centre of that arc is exactly at the gas spring pivot point 115 of the gas spring 106, as this would allow switching of the top of the gas springs between the various connection points without changing the position of the rest of the mechanism 104. This is an advantage, as it means that the gas springs can be more easily moved between the connection points 132 one gas spring at a time. Consequently, this disclosure incorporates this advantage, and has a pattern of points at which the top of the gas spring can connect pivotally to the supporting arms 120, such that when the work surface is in its raised position, the pattern of the connection points describes an arc centred on the gas spring pivot point 115 where the bottom of the gas springs 106 connect pivotally to the stationary mounting bracket 114.

Advantages of the current system include, but are not limited to, an assistive counterbalancing lifting force for the work surface which is more consistent through its range of motion; a variety of strengths of lifting forces for the work surface, to accommodate a variety of work surface weights or loads and an ability to change easily between lifting forces, one gas spring at a time.

Figure 7:
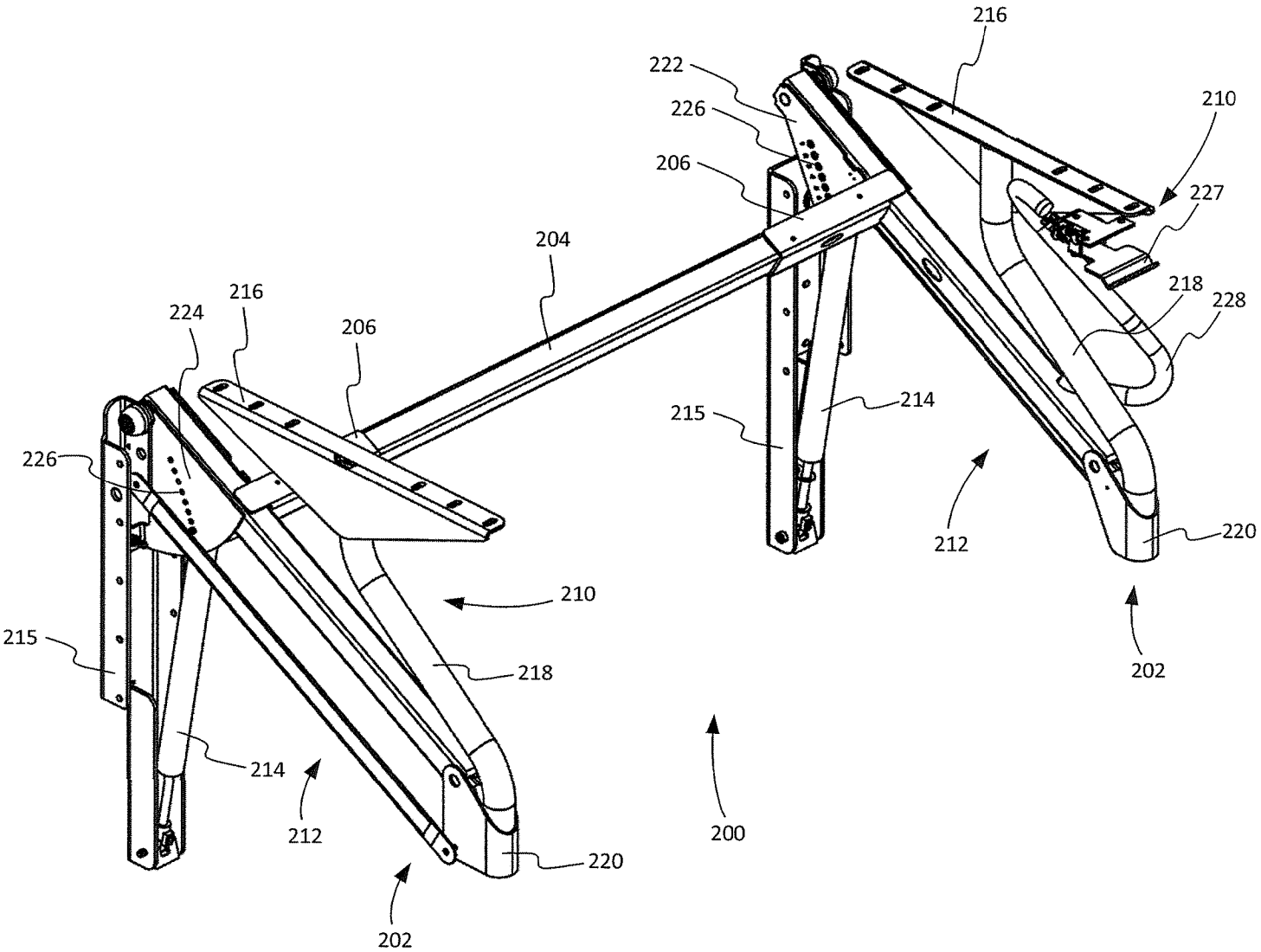
FIG. 7 is a perspective view of another embodiment of apparatus for providing an assistive work surface lifting force for a height-adjustable work surface.

Turning to FIG. 7, a perspective view of another embodiment of apparatus for providing an assistive work surface lifting force for a height-adjustable work surface is shown. The apparatus 200 includes a set of height-adjusting mechanisms 202 that are mounted to an underside of the work surface (not shown). In the current embodiment, the system 200 includes two mechanisms 202 which are to be located at opposite ends of the work surface. The width between the two mechanisms 202 may be controlled by a central crossbar 204. The crossbar 204 is housed within brackets 206 extending from each of the height-adjusting mechanisms 202. The crossbar 204 may slide within the brackets to increase or decrease the space between the two mechanisms 202. In one embodiment, the crossbar 204 includes a set of holes for receiving fasteners that connect the bracket 206 to the crossbar 204. The crossbar 204 assists to co-ordinate the movement of the mechanisms 202 when adjusting the height of the work surface.

Each of the mechanisms 202 includes a work surface mounting apparatus 210, a parallel arm structure 212 and a gas spring 214. As will be disclosed in more detail below, each mechanism 202 is connected to a stationary mounting bracket 215 that allows the apparatus (and work surface) to be mounted such as disclosed above.

The work surface mounting apparatus 210 includes a work surface mounting bracket 216 and an arm 218. The arm 218 extends away from the work surface and is connected to the parallel arm structure 212 via a pivoting bracket 220 which may be seen as being part of the work surface mounting apparatus 210. As such, the work surface mounting apparatus 210 is able to pivot with respect to the parallel arm structure 212 to assist in adjusting the height of the work surface. Each mechanism 202 further includes a pair of plates (seen as inner 222 and outer 224) plates located proximate the stationary mounting bracket 215. Each of the plates 222 and 224 include a set of holes 226, seen as gas spring connection points. The top of the gas spring 214 preferably includes a hole for receiving a fastener that fits within one of the connection points 226 within the plates 222 and 224.

In the current embodiment, actuation of the height adjustment aspect of the system is via a paddle 227, preferably located proximate one of the mechanisms 202. Actuation of the paddle 227 causes the gas springs 214 to actuate, thereby allowing the height of the work surface to be adjusted. In one embodiment, tubing 228 contains Bowden cables or another system for connecting the paddle and the gas springs to allow the paddle to actuate the gas springs. The gas springs 214 lock when not actuated by the paddle 227, allowing the work surface to be fixed in place and used at any level within the range limits of the mechanism.

In order to be able to handle a range of weights which may be placed atop the work surface, a connection point within the group of connection points 226 may be selected for connection with the gas spring which best assists to provide a lifting force to balance the typical weight that the user expects the work surface to handle. For example, in the current embodiment, the set of holes 226 includes eight (8) holes. By moving the connection point between the gas spring 214 and the system 200, the amount of weight that the work surface may be able to handle or bear can be increased or decreased. In this manner, there is more flexibility to the amount of weight the work surface may be able to handle while only using a single gas spring per mechanism 202. Also, as described above, the positioning of the connection points also allows for approximately the same lifting force to be experienced during the full range of motion of the work surface. Current gas spring height-adjustable systems are typically rated for a single specific weight or lifting force.

Figure 8A:
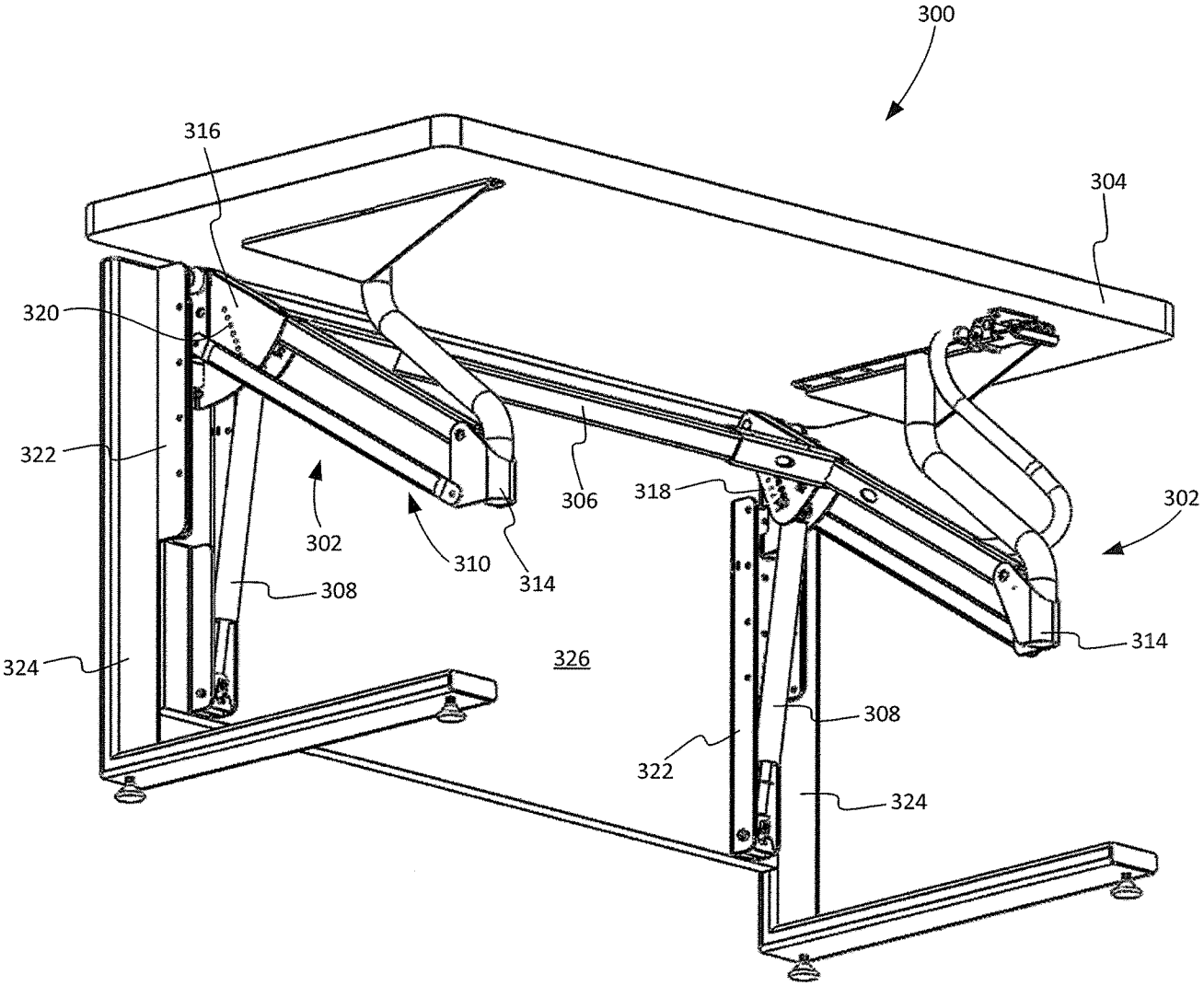
FIGS. 8*a* to 8*c* are views of a stand-alone height-adjustable worksurface with apparatus for providing an assistive work surface lifting force for a height-adjustable work surface.
Figure 8B:
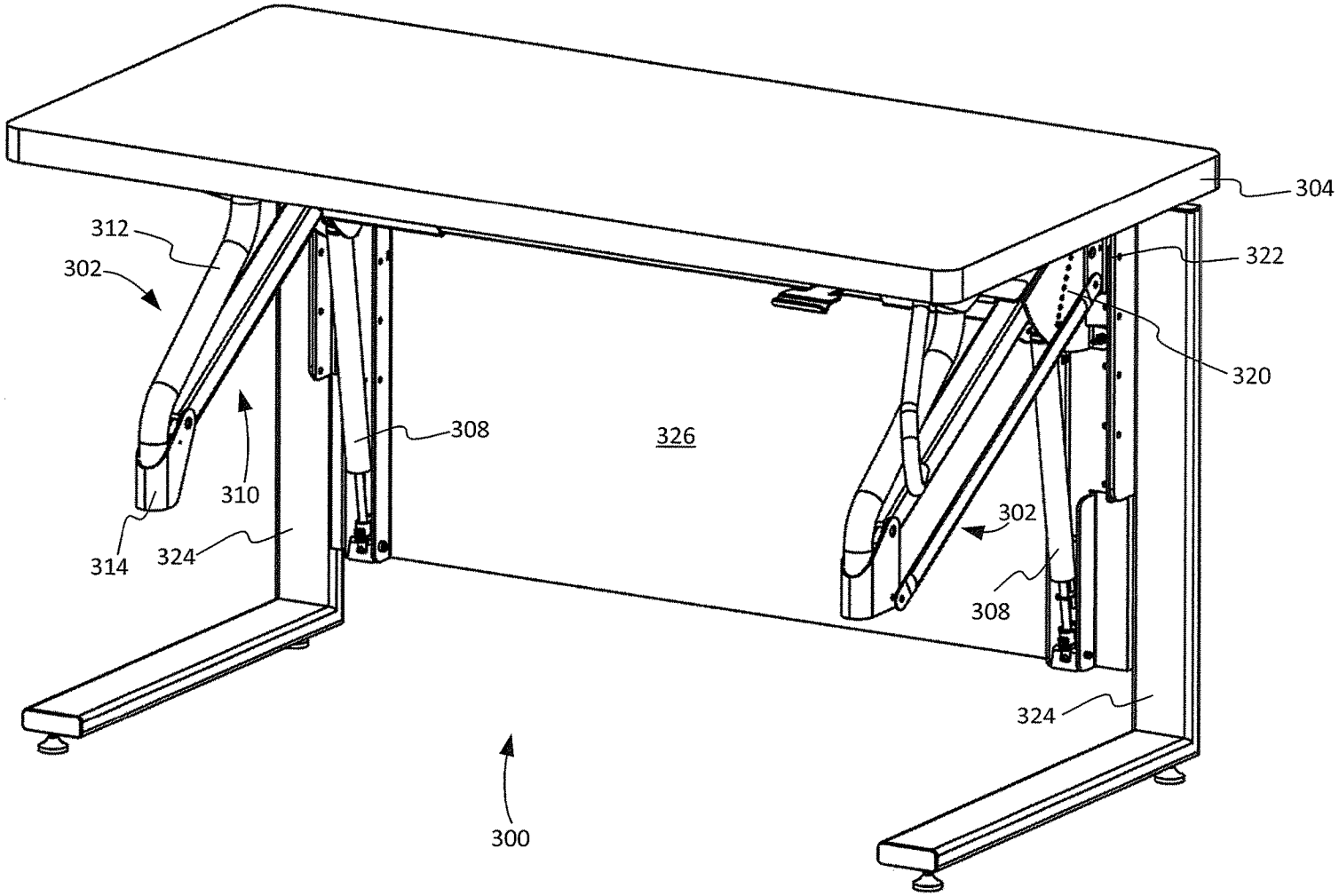
Figure 8C:
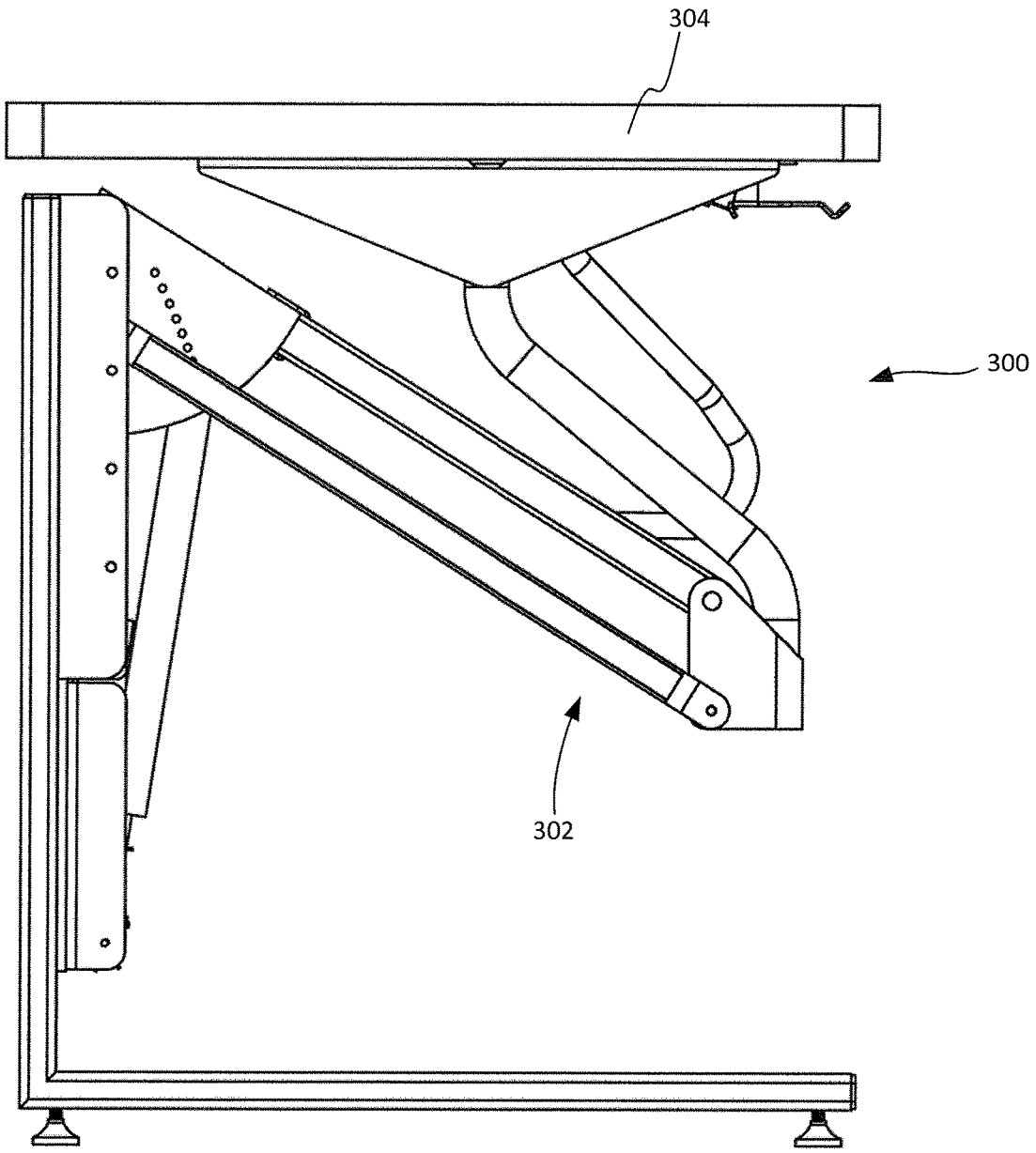

Turning to FIGS. 8*a* to 8*c*, a stand-alone height-adjustable work surface is shown. The system 300 shown in FIGS. 8*a* to 8*c* is similar to the systems disclosed above. The current system includes a pair of work surface mechanisms 302 which are connected to an underside of a work surface 304. A central crossbar 306 connects the two mechanisms 302 to support the mechanisms and also to assist in maintaining a predetermined distance between the two mechanisms 302 to co-ordinate movement of the mechanisms when the height of the work surface 304 is adjusted. The mechanisms 302 further include a gas spring 308 for assisting in the adjustment of the height of the work surface as well as to assist in the weight-bearing capacity of the work surface. Operation of the gas springs 308 will be understood by one skilled in the art.

The mechanisms 302 further include a parallel arm structure 310 connected pivotally to a bracket 314 which is attached to arm 312. Each mechanism 302 further includes a pair of plates 316 and 318 including a set of connecting points 320 for connection with the gas spring 308. The amount of weight that the work surface is tuned to balance may be changed by selecting a different connection point among the various connection points 320 between the gas spring 308 and the plates 316 and 318 as disclosed above.

In the current embodiment, the system 300 is connected to a stationary bracket 322 which is mounted to a set of legs 324. A back wall, or modesty panel, 326 may be also provided.

The current embodiment may be seen as a stand-alone weight-bearing (or assistive lifting force) adjustable and height-adjustable work surface whereby the work surface may be moved to different locations rather than be mounted to a wall. Although not shown, in another embodiment, the bottom of the legs may include wheels so that the stand-alone work surface may be rolled from place to place. In this embodiment, it is preferred that the legs also include a stop so that the stand-alone work surface does not roll when not desired.

Turning to FIGS. 9*a* to 9*f*, various views of another embodiment of apparatus for providing assistive work surface lifting force for a height-adjustable work surface is shown. In these figures, the apparatus may be designed to allow the work surface to bear heavier weights. In one embodiment, these higher weights may be between 60 and 150 pounds.

As with the other embodiments, the apparatus 400 includes a pair of mechanisms 402 that support the work surface. Each of the mechanisms 402 includes a work surface mounting bracket 404 for attachment of the mechanism 402 to an underside of the work surface. The work surface bracket 404 and an arm 406 may be seen as a work surface mounting apparatus 408.

The mechanism further includes a somewhat parallel arm structure 410 pivotally connected to the arm 406 via a bracket 412. Each mechanism 402 further includes a gas spring 414.

In the current embodiment, the mechanism 402 includes a pair of plates 416 with a set of gas spring connection points 418, whereby the set of gas spring connection points preferably form an arc. In the current design, the set of connection points 418 and their location within the plates 416 is designed to allow the work surface to handle more weight and to provide a more consistent lifting force over a range of motion of the work surface. By changing the angle of the gas spring 414, an increased amount of pressure may be exerted by the gas spring 414 to handle increased weight bearing requirements. In order to handle an increased weight bearing requirement, the connection between the parallel arm structure 410, the plates 416 and the stationary mounting bracket 420 may be altered.

Figure 9A:
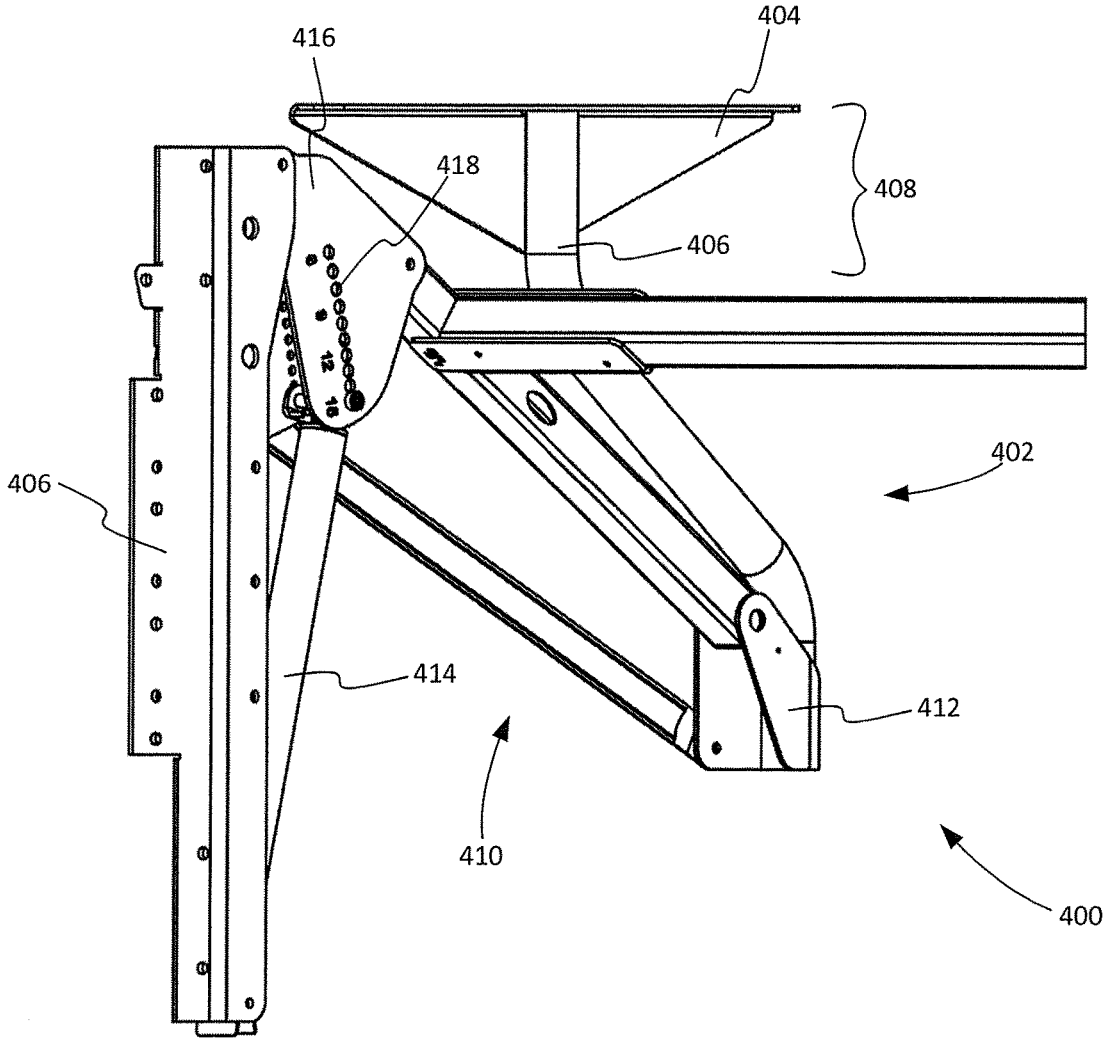
FIGS. 9*a* to 9*f* are views of another embodiment of apparatus for providing an assistive work surface lifting force for a height-adjustable work surface.
Figure 9B:
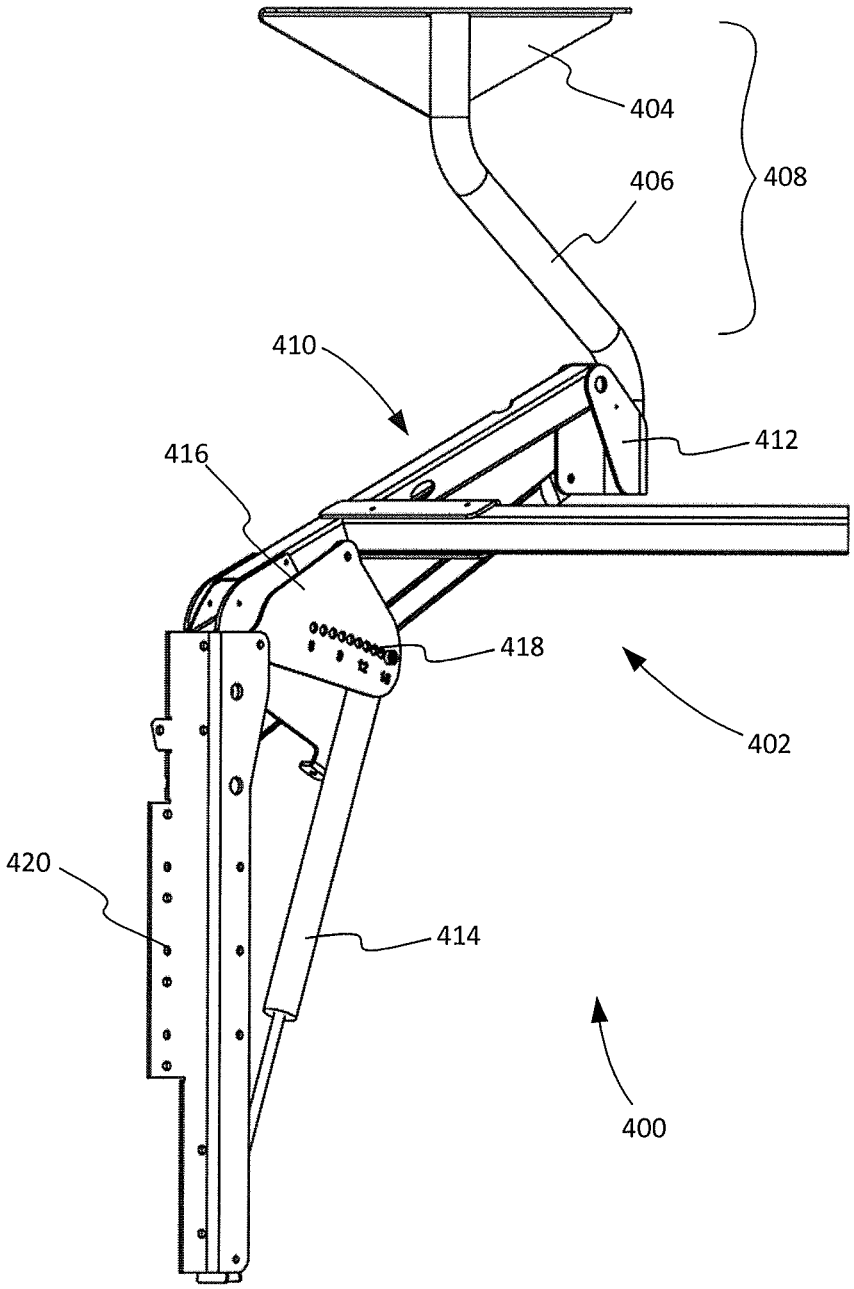
Figure 9C:
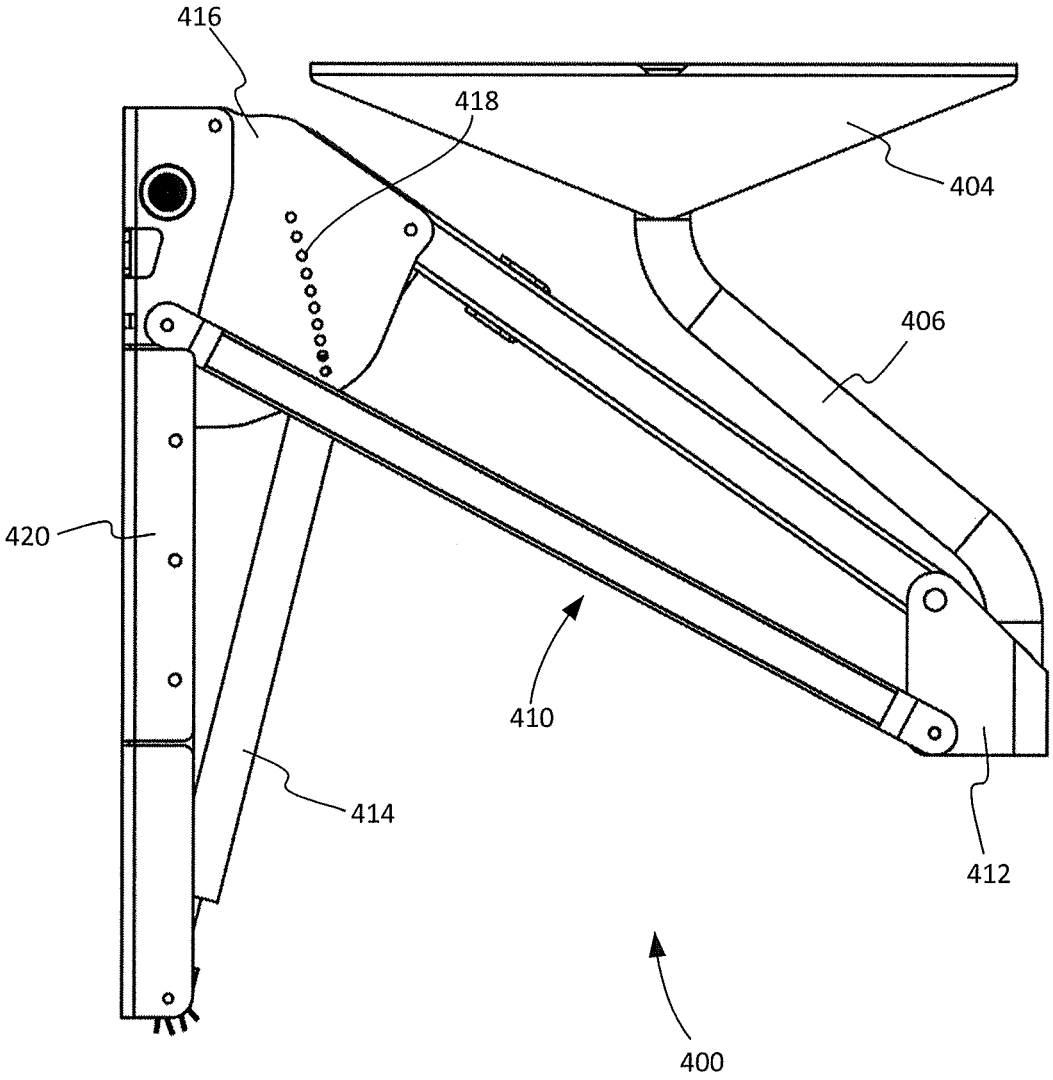
Figure 9D:
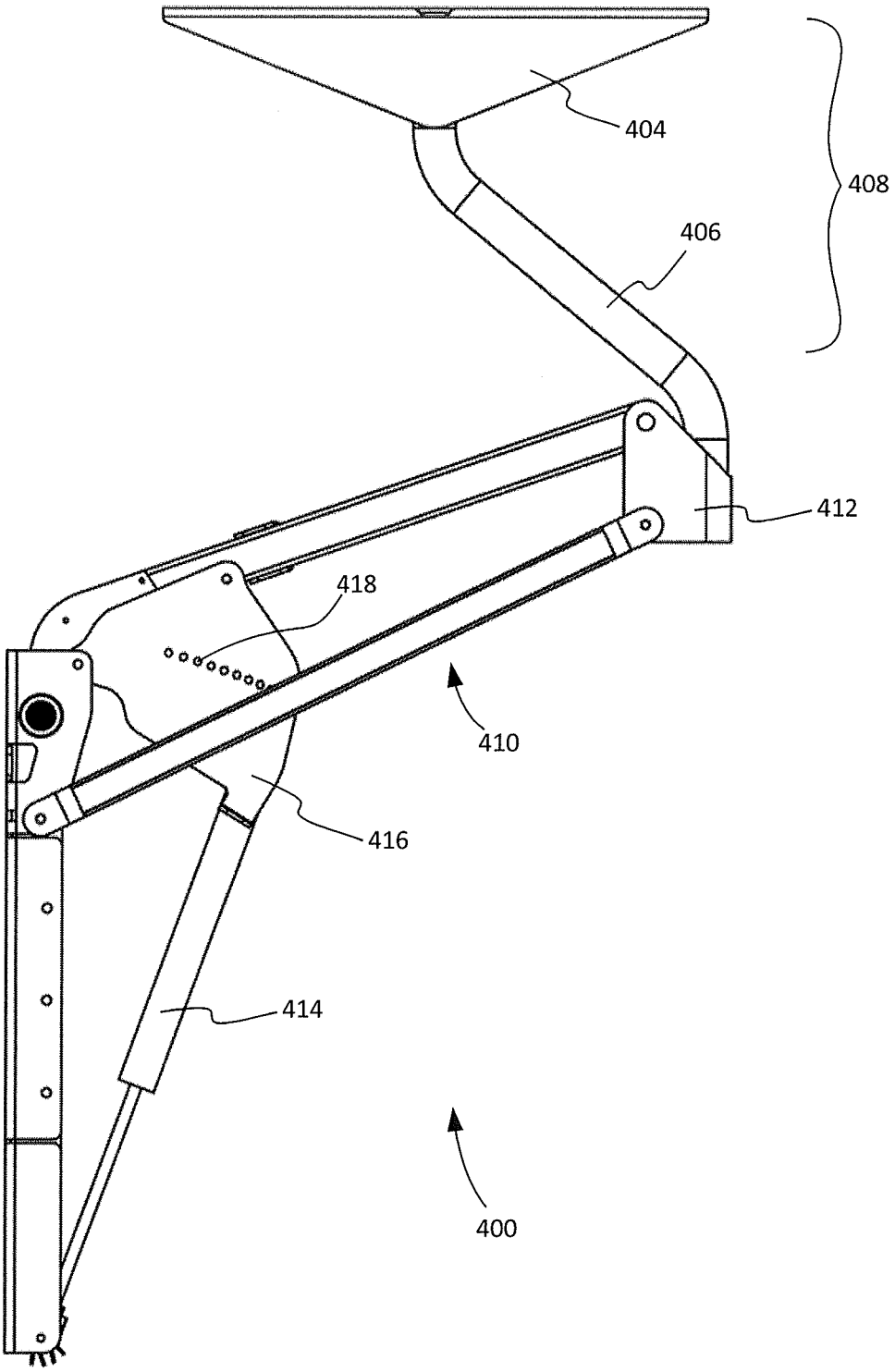
Figure 9E:
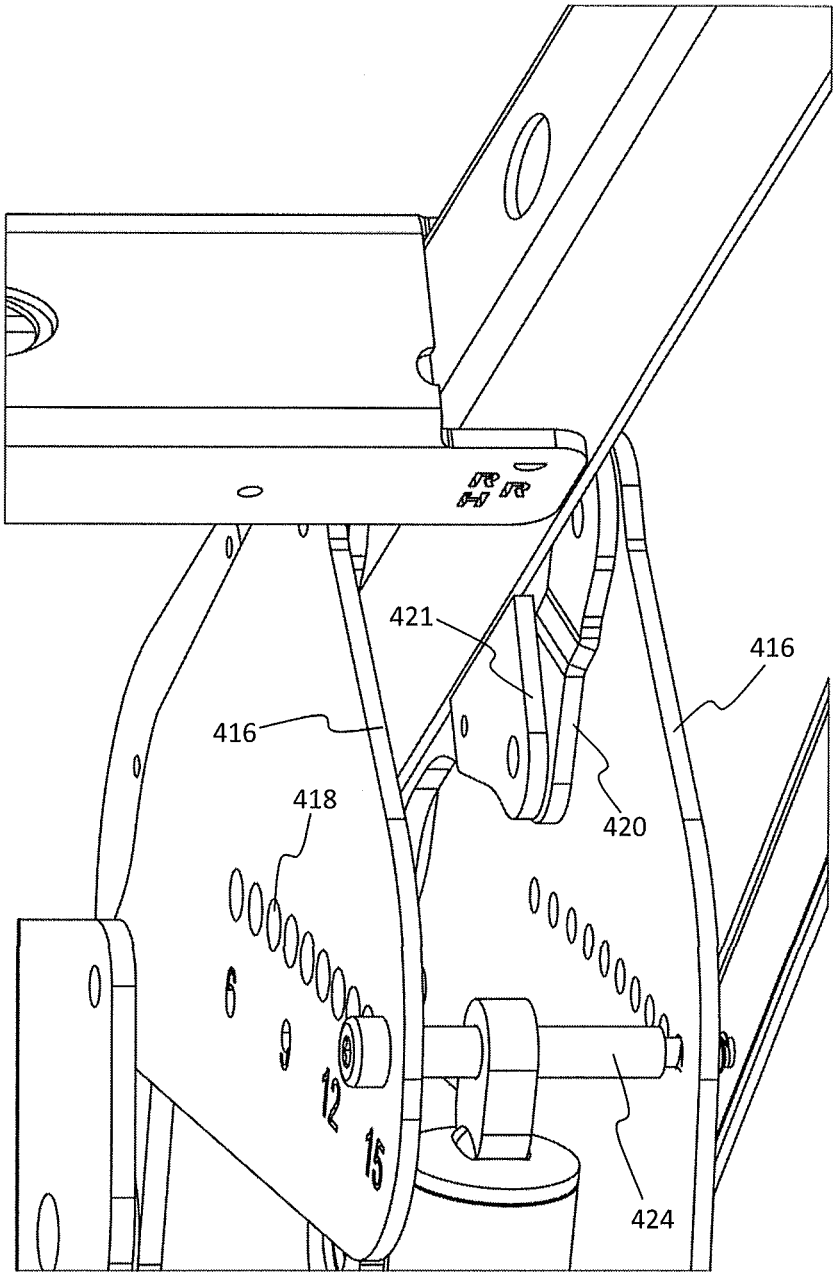
Figure 9F:
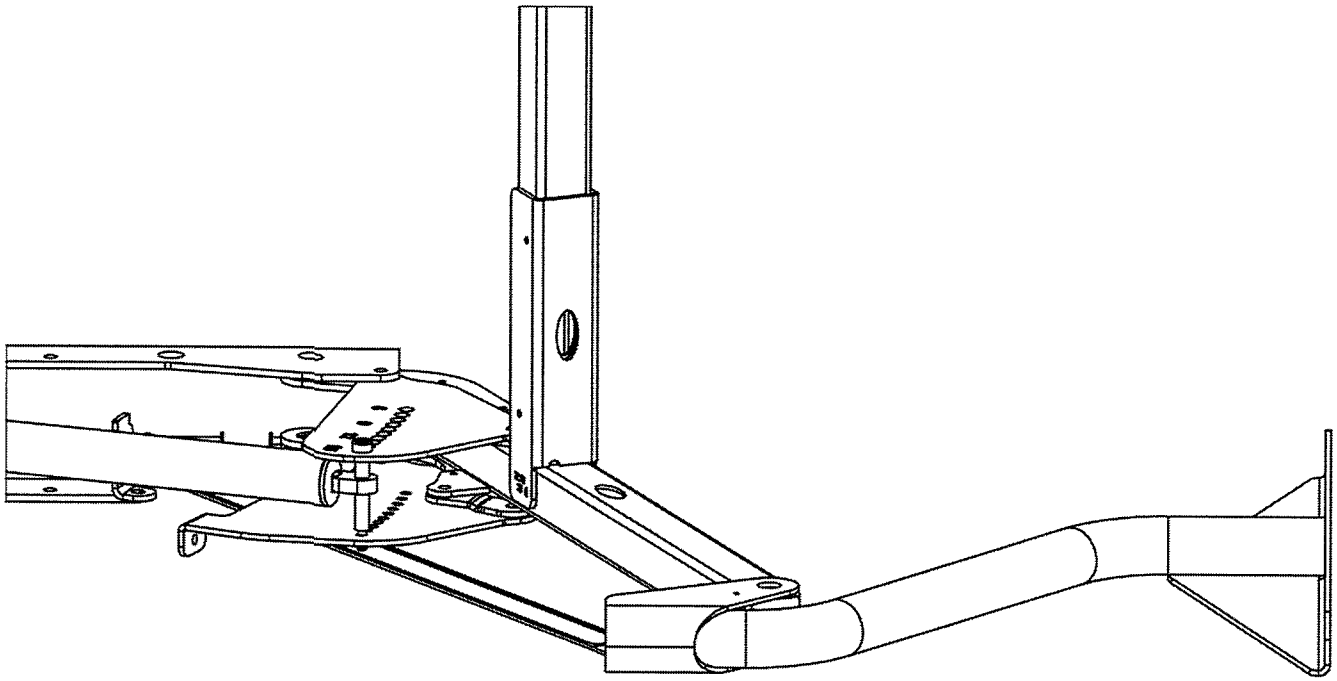

In FIGS. 9*e* and 9*f*, it can be seen that the primary arm of the parallel arm structure 410 is connected to the plates 416 via an intermediary linkage 420. The intermediary linkage 420 is connected to a bracket 421 which may be seen as part of the parallel arm structure 410. The intermediary linkage 420 connects pivotally to bracket 421 which is preferably welded to the parallel arm structure 410. This intermediary linkage 420 allows the parallel arm structure to rotate with respect to the plates 416 and the stationary mounting bracket to assist in adjusting the height of the work surface. In the current embodiment, the primary and second arms of the parallel arm structure 410 are pivotally connected to the mounting bracket but not at the parallel arm fulcrum point.

As can be seen in FIG. 9*e*, the gas spring 414 is connected to the set of connection points at a top end of the gas spring. The connection between the top of the gas spring and the set of connections points may be via a shoulder bolt 424. In the current embodiment, the gas spring is connected to the connection point labelled 15. In this embodiment, connection point 15 represents a setting for a highest available assistive lifting force of about 150 pounds. At the other end of the connection points, the final point is labelled 6. This represents a setting for a lowest available assistive lifting force of about 60 pounds.

In the preceding description, for purposes of explanation, numerous details are set forth in order to provide a thorough understanding of the embodiments. However, it will be apparent to one skilled in the art that these specific details may not be required in order to practice the invention. In some instances, well-known structures may be shown in block diagram form in order not to obscure the invention. For example, specific details are not provided as to whether the embodiments of the invention described herein are implemented as a software routine, hardware circuit, firmware, or a combination thereof.

Embodiments of the disclosure can be represented as a computer program product stored in a machine-readable medium (also referred to as a computer-readable medium, a processor-readable medium, or a computer usable medium having a computer-readable program code embodied therein). The machine-readable medium can be any suitable tangible, non-transitory medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described implementations can also be stored on the machine-readable medium. The instructions stored on the machine-readable medium can be executed by a processor or other suitable processing device, and can interface with circuitry to perform the described tasks.

Various embodiments are described herein. Variations of those embodiments may become apparent to those of ordinary skill in the art upon reading the foregoing description. It is expected that skilled persons will employ such variations as appropriate, and it is expected that the disclosure may be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Further variations may be apparent or become apparent to those knowledgeable in the field, and are within the scope as defined by the claims.

What is claimed is:

1. A system for providing an adjustable assistive lifting force for a height-adjustable work surface comprising:

a height-adjustable work surface apparatus, the height-adjustable work surface apparatus including a set of gas springs;

a pair of plates, each of the plates including a set of connection points for receiving a fastening apparatus connecting the plates to one of the set of gas springs;

wherein the set of connection points are in an arc with respect to a target pivot point;

wherein changing connection of a fastening apparatus between one of the set of connection points to another of the set of connection points does not adjust a height of the height-adjustable work surface.

2. The system of claim 1 wherein the fastening apparatus is a shoulder bolt.

3. The system of claim 1 wherein the height-adjustable work surface apparatus comprises a pair of work surface mechanisms, each work surface mechanism including:

a work surface mounting apparatus;

a parallel arm structure, the parallel arm structure at a first end in pivotable connection with the work surface mounting apparatus; and a stationary mounting bracket for receiving a second end of the parallel arm structure.

4. The system of claim 3 wherein the pair of plates are welded to the parallel arm structure.

5. The system of claim 3 wherein the pair of plates are connected to the parallel arm structure via an intermediary linkage.

6. The system of claim 3 wherein the work surface mounting apparatus comprises:

a work surface mounting bracket; and an arm extending from the work surface mounting bracket.

7. The system of claim 1 wherein connection between the gas spring and one of the set of connection points allows for a generally consistent lifting force throughout a range of motion of the parallel arm structure.

8. The system of claim 3 further comprising a set of legs attached to the stationary mounting bracket.

9. The system of claim 3 further comprising a crossbar connecting the pair of work surface mechanisms.

10. The system of claim 3 further comprising a crossbar bracket connected to each of the pair of work surface mechanisms for receiving the crossbar.

11. The system of claim 10 wherein the crossbar bracket is welded to the associated work surface mechanism.

12. A system for providing adjustable assistive lifting forces to a height-adjustable work surface comprising:

a pair of plates, each of the plates including a set of gas spring connection points;

a fastening apparatus for connecting a gas spring to one of the gas spring connection points;

wherein the set of gas spring connection points form an arc centred about a target pivot point;

wherein changing connection of the fastening apparatus between one of the set of gas spring connection points to another of the set of gas spring connection points does not adjust a height of the height-adjustable work surface.

13. The system of claim 12 wherein the target pivot point is a gas spring pivot point.

14. The system of claim 12 wherein the gas spring connection points are designed to provide a more constant assistive lifting force to a work surface over a range of motion of the work surface.

15. The system of claim 12 wherein the pair of plates are mounted to an apparatus for adjusting a height of the height-adjustable work surface.

16. The system of claim 15 wherein the pair of plates are welded to the apparatus for adjusting the height.

17. The system of claim 15 wherein the pair of plates are connected to the apparatus via an intermediary linkage.

* * * * *